US009163836B1

(12) United States Patent
Dai

(10) Patent No.: US 9,163,836 B1
(45) Date of Patent: Oct. 20, 2015

(54) CIGARETTE LIGHTER ASSEMBLY

(71) Applicant: Samer Dai, Riverside, CA (US)

(72) Inventor: Samer Dai, Riverside, CA (US)

( * ) Notice: Subject to any disclaimer, the term of this patent is extended or adjusted under 35 U.S.C. 154(b) by 287 days.

(21) Appl. No.: 14/016,605

(22) Filed: Sep. 3, 2013

(51) Int. Cl.
*F23D 14/46* (2006.01)
*F23Q 2/28* (2006.01)
*F23Q 2/36* (2006.01)

(52) U.S. Cl.
CPC . *F23Q 2/287* (2013.01); *F23Q 2/36* (2013.01)

(58) Field of Classification Search
CPC ..... F23Q 2/287; F23Q 2/36; F23D 14/46
USPC ..... 431/255, 344, 345, 266; 126/409
See application file for complete search history.

(56) References Cited

U.S. PATENT DOCUMENTS 342,913 A * 6/1886 King ..... 431/252
4,198,992 A * 4/1980 Smith ..... 131/330
4,462,791 A 7/1984 Hayden
4,502,465 A * 3/1985 Yoshinaga et al. ..... 126/409
D295,598 S 5/1988 Takase
5,154,601 A * 10/1992 Lloveras Capilla ..... 431/255
5,201,677 A * 4/1993 Takayama ..... 439/668
5,348,194 A * 9/1994 Mascitelli et al. ..... 222/209
D382,444 S 8/1997 Ferrara, Jr.
D454,032 S 3/2002 Xu
6,997,702 B1 * 2/2006 Chen ..... 431/344
7,563,094 B2 * 7/2009 Yang ..... 431/153
2008/0050686 A1 2/2008 Sewalt
2014/0290650 A1 * 10/2014 Ivey ..... 128/202.21

* cited by examiner

*Primary Examiner* — Gregory Huson
*Assistant Examiner* — Nikhil Mashruwala

(57) ABSTRACT

A cigarette lighter assembly includes a conduit and a reservoir fluidly coupled together. The conduit has a free end positioned distal of the reservoir and the reservoir stores a quantity of fuel. A valve is in fluid communication with the reservoir and is positionable in an opened condition to allow fuel to flow into the conduit. A valve actuator is mechanically coupled to the valve. An ignition actuator is in communication with the conduit and ignites the fuel as the fuel exits the distal end. The ignition actuator is a piezoelectric actuator. A resiliently flexible bulb is attached to the conduit. The ignition actuator is positioned within the bulb and the ignition actuator is actuated when the bulb is compressed.

5 Claims, 3 Drawing Sheets

CIGARETTE LIGHTER ASSEMBLY

BACKGROUND OF THE DISCLOSURE

Field of the Disclosure

The disclosure relates to cigarette lighting devices and more particularly pertains to a new cigarette lighting device for assisting a person having limited dexterity in producing a flame such that the flame may be used to ignite a cigarette, cigar or the like.

SUMMARY OF THE DISCLOSURE

An embodiment of the disclosure meets the needs presented above by generally comprising a conduit and a reservoir fluidly coupled together. The conduit has a free end positioned distal of the reservoir and the reservoir is configured to store a quantity of fuel. A valve is in fluid communication with the reservoir and is positionable in an opened condition to allow fuel to flow into the conduit. A valve actuator is mechanically coupled to the valve. An ignition actuator is in communication with the conduit and is configured to ignite the fuel as the fuel exits the distal end. The ignition actuator comprises a piezoelectric actuator. A resiliently flexible bulb is attached to the conduit. The ignition actuator is positioned within the bulb and the ignition actuator is actuated when the bulb is compressed.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
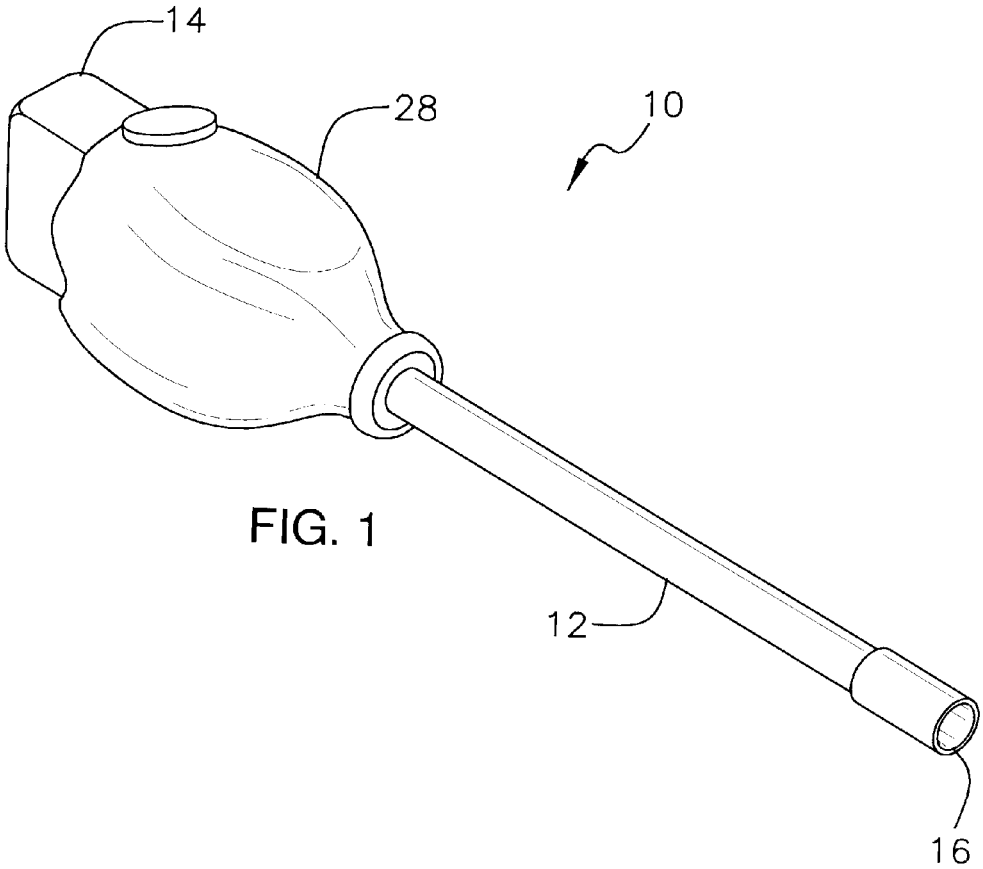
FIG. 1 is a front perspective view of a cigarette lighter assembly according to an embodiment of the disclosure.
Figure 2:
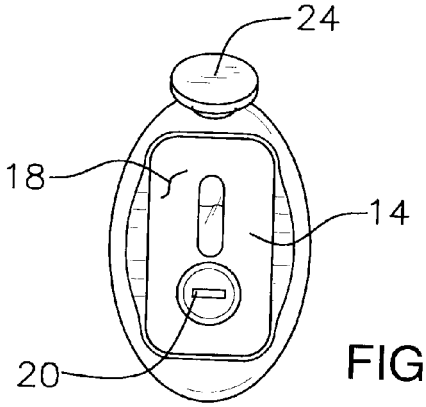
FIG. 2 is a rear view of an embodiment of the disclosure.
Figure 3:
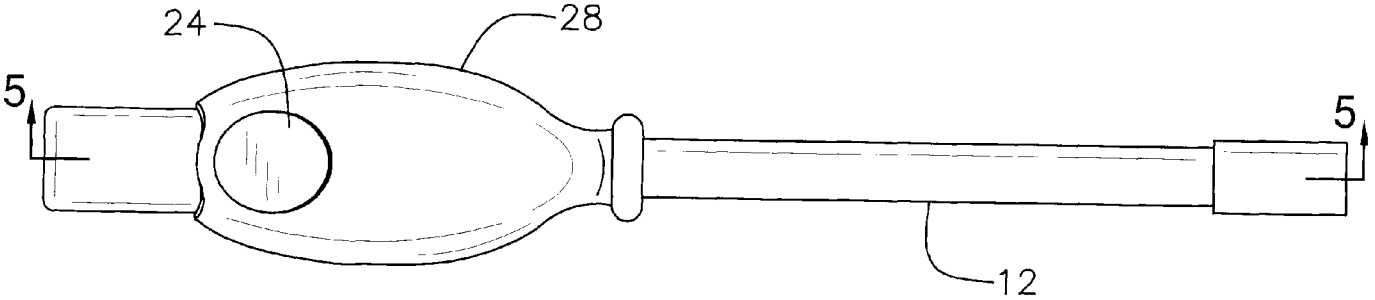
FIG. 3 is a top view of an embodiment of the disclosure.
Figure 4:
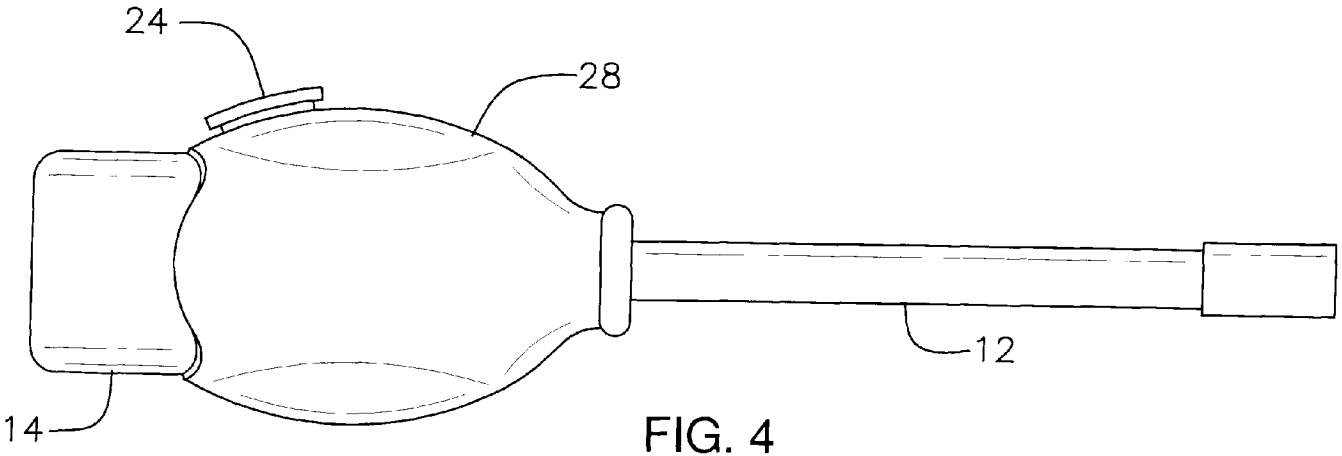
FIG. 4 is a side view of an embodiment of the disclosure.
Figure 5:
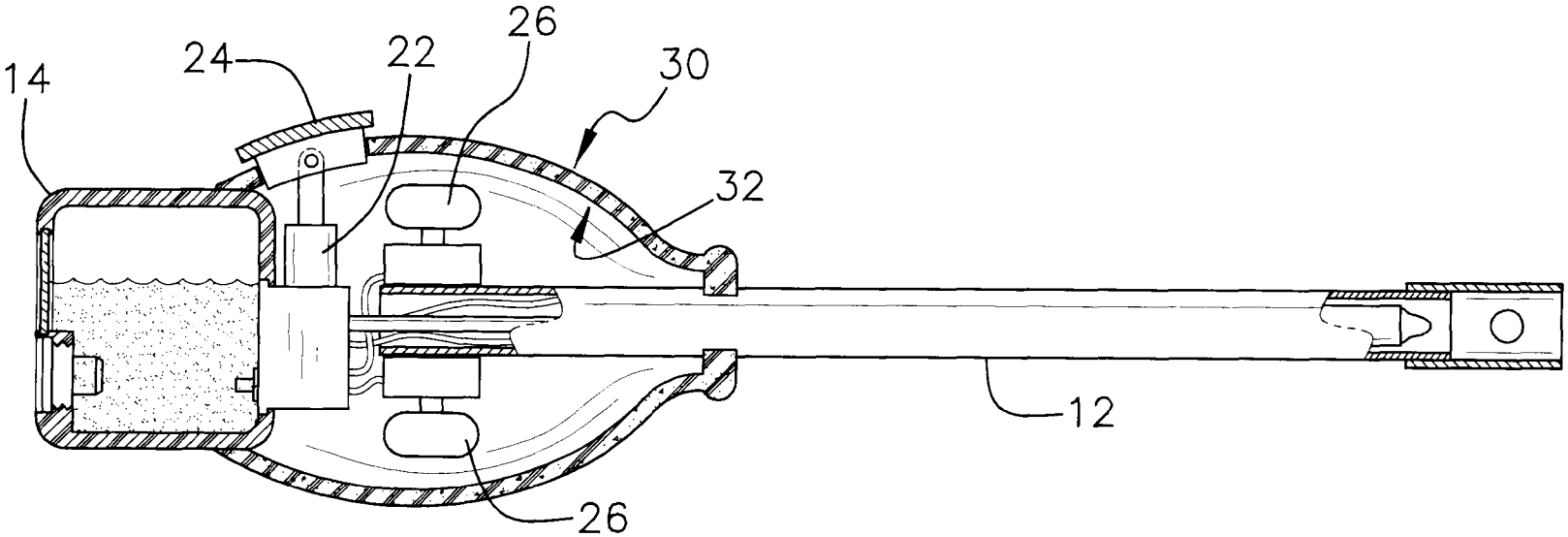
FIG. 5 is a broken view of an embodiment of the disclosure taken along line 5-5 of FIG. 3.

With reference now to the drawings, and in particular to FIGS. 1 through 5 thereof, a new cigarette lighting device embodying the principles and concepts of an embodiment of the disclosure and generally designated by the reference numeral 10 will be described.

As best illustrated in FIGS. 1 through 5, the cigarette lighter assembly 10 generally comprises a conduit 12 and a reservoir 14 is fluidly coupled together. The conduit 12 has a free end 16 positioned distal of the reservoir 14. The conduit

12 has a length less than 25.0 cm and may have a length equal to at least 10 cm. The reservoir 14 is configured to store a quantity of fuel. The fuel may be any conventional fuel used for lighting a cigarette, cigar or the like. The fuel, in particular, may comprise butane. The reservoir 14 includes a perimeter wall 18 that may have a removable plug 20 or a one-way valve therein, which is configured to receive fuel.

A valve 22 is in fluid communication with the reservoir 14. The valve 22 is positionable in an opened condition to allow fuel to flow into the conduit 12. A valve actuator 24 is mechanically coupled to the valve 22. A pair of ignition actuators 26 is in communication with the conduit 12 and is configured to ignite the fuel as the fuel exits the distal end 16. The ignition actuators 26 each comprise a piezoelectric actuator and the ignition actuators 26 are positioned opposite of each other. The conduit 12, reservoir 14, valve 22 and ignition actuators 26 are conventional to piezoelectric cigarette lighters.

A bulb 28 is attached to the conduit 12 and the ignition actuator 26 is positioned within the bulb 28. The bulb 28 comprises a resiliently flexible material. At least one of the ignition actuator 26 is actuated when the bulb 28 is compressed. The bulb 28 has an outer surface 30 that is bulbous and convexly arcuate. An inner surface 32 of the bulb 28 may be spaced from the ignition actuators 26 when the bulb 28 in an uncompressed condition. The valve actuator 24 may be positioned that it extends through the bulb 28 such that it may be actuatable when the bulb 28 is compressed. The bulb 28 may have a length between 7.0 cm and 12.5 cm and a greatest width less than 8.0 cm.

In use, the assembly 10 is used in a conventional manner for igniting a cigarette, cigar, pipe or the like. The bulb 28 is squeezed, or compressed, by a user such that the ignition actuator 26 is actuated. As a piezoelectric switch, it should be understood that such actuation will produce an electric discharge which will ignite the fuel as it exits the conduit. The shape of the bulb 28 will allow someone with limited dexterity to more easily produce a flame with a cigarette lighter.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cigarette lighter assembly comprising:

a conduit and a reservoir being fluidly coupled together, said conduit having a free end positioned distal of said reservoir, said reservoir being configured to store a quantity of fuel;

a valve in fluid communication with said reservoir, said valve being positionable in an opened condition to allow fuel to flow into said conduit, a valve actuator being mechanically coupled to said valve;

a pair of ignition actuators being in communication with said conduit and being configured to ignite the fuel as the fuel exits said distal end, said ignition actuators each comprising a piezoelectric actuator;

a bulb being attached to said conduit, said ignition actuators, being positioned within said bulb, said bulb comprising a resiliently flexible material, at least one of the said ignition actuator being actuated when said bulb is compressed; and wherein said ignition actuators positioned opposite of each other, at least one of said ignition actuators being actuated when said bulb is compressed.

2. The cigarette lighter assembly according to claim 1, wherein said bulb has an outer surface being bulbous and convexly arcuate, an inner surface of said bulb being spaced from said ignition actuators when said bulb in an uncompressed condition.

3. The cigarette lighter assembly according to claim 1, wherein said valve actuator extends through said bulb, said valve actuator being actuatable when said bulb is compressed.

4. The cigarette lighter assembly according to claim 1, wherein said reservoir includes a perimeter wall having a one-way valve therein, said one-way valve being configured to receive fuel.

5. A cigarette lighter assembly comprising:

a conduit and a reservoir being fluidly coupled together, said conduit having a free end positioned distal of said reservoir, said reservoir being configured to store a quantity of fuel;

a valve in fluid communication with said reservoir, said valve being positionable in an opened condition to allow fuel to flow into said conduit, a valve actuator being mechanically coupled to said valve;

a pair of ignition actuators being in communication with said conduit and being configured to ignite the fuel as the fuel exits said distal end, said ignition actuators each comprising a piezoelectric actuator, said ignition actuators being positioned opposite of each other;

a bulb being attached to said conduit, said ignition actuator being positioned within said bulb, said bulb comprising a resiliently flexible material, at least one of said ignition actuator being actuated when said bulb is compressed;

said bulb having an outer surface being bulbous and convexly arcuate, an inner surface of said bulb being spaced from said ignition actuators when said bulb in an uncompressed condition;

said valve actuator extending through said bulb, said valve actuator being actuatable when said bulb is compressed; and said reservoir including a perimeter wall having a one-way valve therein, said one-way valve being configured to receive fuel.

* * * * *